US011364411B2

(12) United States Patent
Yoo et al.

(10) Patent No.: US 11,364,411 B2
(45) Date of Patent: Jun. 21, 2022

(54) TREADMILL

(71) Applicant: DRAX INC., Anyang-si (KR)

(72) Inventors: Seon Kyung Yoo, Seoul (KR); Jae Sang Park, Seongnam-si (KR)

(73) Assignee: Drax Inc., Anyang-si (KR)

( * ) Notice: Subject to any disclaimer, the term of this patent is extended or adjusted under 35 U.S.C. 154(b) by 0 days.

(21) Appl. No.: 16/722,897

(22) Filed: Dec. 20, 2019

(65) Prior Publication Data

US 2020/0254302 A1 Aug. 13, 2020

(30) Foreign Application Priority Data

Feb. 11, 2019 (KR) ..... 10-2019-0015556

(51) Int. Cl.
*A63B 22/02* (2006.01)
*A63B 21/00* (2006.01)
*A63B 71/06* (2006.01)

(52) U.S. Cl.
CPC ..... *A63B 22/02* (2013.01); *A63B 21/15* (2013.01); *A63B 2071/0658* (2013.01)

(58) Field of Classification Search
CPC . A63B 21/15; A63B 2071/0658; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 22/04;
(Continued)

(56) References Cited

U.S. PATENT DOCUMENTS 5,336,145 A * 8/1994 Keiser ..... A63B 22/025 482/54
5,382,207 A * 1/1995 Skowronski ..... A63B 22/025 482/904

(Continued)

FOREIGN PATENT DOCUMENTS

KR 10-2018-0010521 A 1/2018

OTHER PUBLICATIONS

Office Action in corresponding Korean Patent Application No. 10-2019-0015556 dated Jan. 14, 2020, 4 pages.

(Continued)

*Primary Examiner* — Megan Anderson
*Assistant Examiner* — Thao N Do
(74) *Attorney, Agent, or Firm* — Knobbe Martens Olson & Bear LLP

(57) ABSTRACT

A treadmill is provided. A rotation device rotatably supporting a track unit of the treadmill includes a pair of bearing trains rotatably installed at a frame structure and including a plurality of first bearings arranged along a movement direction of a belt to guide a movement of an upper region of a pair of belts and a front rotation module and a rear rotation module rotatably installed at the frame structure and respectively arranged at a front side and a rear side of the pair of bearing trains. At least one of the front rotation module and the rear rotation module includes a pair of rotation members arranged spaced apart from each other in a direction perpendicular to a rotation direction thereof and a pair of rotation support units supporting the pair of rotation members such that the pair of rotation members rotate individually.

15 Claims, 16 Drawing Sheets

(58) Field of Classification Search

CPC ..... A63B 22/06; A63B 2022/0271; A63B 2022/0278; A63B 71/0619; A63B 2069/0031; A63B 2069/0033; A63B 22/0664; A63B 2022/067; A63B 2022/0676; A63B 2022/0682; A63B 2022/0688; A63B 2022/206; A63B 69/0028

USPC ..... 482/54

See application file for complete search history.

(56) References Cited

U.S. PATENT DOCUMENTS

| | | | | |
|---|---|---|---|---|
| 5,385,520 | A * | 1/1995 | Lepine | A63B 22/0023 482/54 |
| 6,042,514 | A * | 3/2000 | Abelbeck | A63B 22/02 482/54 |
| 8,308,619 | B1 * | 11/2012 | Astilean | A63B 21/156 482/54 |
| 8,343,016 | B1 | 1/2013 | Astilean | |
| 10,010,748 | B1 * | 7/2018 | Weinstein | A63B 22/0285 |
| 2006/0019783 | A1 * | 1/2006 | Hoag | A63B 22/0235 474/148 |
| 2012/0010053 | A1 * | 1/2012 | Bayerlein | A63B 22/0235 482/54 |
| 2014/0011642 | A1 * | 1/2014 | Astilean | A63B 22/0285 482/54 |
| 2016/0144224 | A1 * | 5/2016 | Dalebout | A63B 22/0285 482/54 |
| 2016/0144225 | A1 * | 5/2016 | Dalebout | A63B 22/02 482/54 |
| 2016/0166877 | A1 * | 6/2016 | Cei | A63B 22/0285 482/54 |
| 2016/0296789 | A1 * | 10/2016 | Astilean | A63B 22/0221 |
| 2016/0367851 | A1 * | 12/2016 | Astilean | B62M 6/40 |
| 2017/0182356 | A1 * | 6/2017 | Cei | A63B 21/157 |
| 2017/0225023 | A1 * | 8/2017 | Crist | A63B 21/0557 |
| 2017/0312566 | A1 * | 11/2017 | Chang | A63B 22/0285 |
| 2017/0312567 | A1 * | 11/2017 | Chang | A63B 22/0285 |
| 2018/0001134 | A1 * | 1/2018 | Bayerlein | A63B 22/0235 |
| 2018/0043206 | A1 * | 2/2018 | Crist | A63B 23/047 |
| 2018/0043207 | A1 * | 2/2018 | Moser | A63B 24/0087 |
| 2018/0104534 | A1 * | 4/2018 | Erkelenz | A63B 22/0235 |
| 2018/0111018 | A1 * | 4/2018 | Lee | A63B 22/0285 |
| 2018/0133544 | A1 * | 5/2018 | Yoo | A63B 22/0285 |
| 2018/0140896 | A1 | 5/2018 | Chen | |
| 2019/0009128 | A1 * | 1/2019 | Yoo | A63B 22/0285 |
| 2019/0060705 | A1 * | 2/2019 | Yoo | A63B 22/0285 |
| 2019/0083844 | A1 * | 3/2019 | Bayerlein | H05F 3/02 |
| 2019/0118030 | A1 * | 4/2019 | Yoo | A63B 22/0046 |
| 2019/0126093 | A1 * | 5/2019 | Yoo | A63B 21/4035 |
| 2019/0168067 | A1 * | 6/2019 | Bates | A63B 21/4033 |
| 2019/0217182 | A1 * | 7/2019 | Kueker | A63B 22/0285 |
| 2019/0344117 | A1 * | 11/2019 | Lo | A63B 22/0214 |
| 2020/0009418 | A1 * | 1/2020 | Lo | A63B 22/0285 |
| 2020/0114198 | A1 * | 4/2020 | Lo | A63B 22/0285 |
| 2020/0129837 | A1 * | 4/2020 | Liao | A63B 22/025 |

OTHER PUBLICATIONS

Second Office Action of Chinese Patent Application No. 201911363165.4—23 pages (dated Jun. 17, 2021).

Office Action in corresponding Korean Patent Application No. 10-2020-0010493—6 pages (dated Apr. 16, 2020).

* cited by examiner

TREADMILL

CROSS-REFERENCE TO RELATED APPLICATION

This application claims the benefit of Korean Patent Application No. 10-2019-0015556, filed on Feb. 11, 2019, in the Korean Intellectual Property Office, the disclosure of which is incorporated herein in its entirety by reference.

BACKGROUND

1. Field

One or more embodiments relate to treadmills.

2. Description of the Related Technology

A treadmill is also called a running machine and refers to an exercise machine that may provide an exercise effect of walking or running in a narrow space via a belt that rotates on a caterpillar. Because treadmills may enable walking or running exercise indoors at moderate temperatures regardless of weather, the demand for such machines has rapidly increased recently.

SUMMARY

The treadmills may be classified into a powered treadmill in which a track unit rotates by a separate driving unit and a non-powered treadmill in which a track unit rotates by the user's movement without a separate driving unit. Because the non-powered treadmill does not require a separate driving unit, it may be arranged at various positions as compared to the powered treadmill. Recently, in such non-powered treadmills, various attempts have been made to allow users to feel as if they are actually exercising on floors. For example, for natural rotation of the non-powered treadmill, attempts have been made to reduce the rotational friction force of the track unit or to reduce the weight of the track unit in consideration of the rotational inertia of the track unit. However, even when the weight of the track unit has been reduced, it has still been difficult to completely reduce the rotational inertia of the track unit.

One or more embodiments include a non-powered treadmill capable of minimizing the rotational inertia of a track unit by reducing the weight of a rotation device rotating the track unit.

Additional aspects will be set forth in part in the description which follows and, in part, will be apparent from the description, or may be learned by practice of the presented embodiments of the disclosure.

According to one or more embodiments, a non-powered treadmill includes: a frame structure; a track unit rotatable with respect to the frame structure; and a rotation device arranged at the frame structure to rotatably support the track unit, wherein the track unit includes: a plurality of slats arranged along a rotation direction of the track unit; and a pair of belts arranged at both end portions of the plurality of slats to connect the plurality of slats to each other, the rotation device includes: a pair of bearing trains rotatably installed at the frame structure and including a plurality of first bearings arranged along a movement direction of the belt to guide a movement of an upper region of the pair of belts; and a front rotation module and a rear rotation module rotatably installed at the frame structure and respectively arranged at a front side and a rear side of the pair of bearing trains, and at least one of the front rotation module and the rear rotation module includes: a pair of rotation members arranged spaced apart from each other in a direction perpendicular to a rotation direction thereof; and a pair of rotation support units supporting the pair of rotation members such that the pair of rotation members rotate individually.

In an embodiment, the rotation member may include a wheel member having a diameter greater than a diameter of the first bearing.

In an embodiment, each of the pair of rotation support units may include: a support shaft fixed to the frame structure; and a bearing assembly arranged at the wheel member such that the wheel member may be rotatable with respect to the support shaft.

In an embodiment, the bearing assembly may include: at least one second bearing; and a connection boss for connecting the second bearing to the wheel member.

In an embodiment, the at least one second bearing may include: a bearing capable of rotating in both directions; and a one-way bearing arranged coaxially with the bearing and restricted to rotate in one direction.

In an embodiment, the connection boss may be arranged to be fixed to the wheel member.

In an embodiment, the bearing assembly may include an insertion hole into which the support shaft is inserted, and the rotation support unit may further include a first stopper arranged around the support shaft to guide an assembly position of the bearing assembly when the bearing assembly is installed at the support shaft through the insertion hole.

In an embodiment, the rotation support unit may further include a second stopper coupled to an end portion of the support shaft such that the bearing assembly may not deviate from the support shaft.

In an embodiment, a material of the wheel member may be lighter than a material of the connection boss and the support shaft.

In an embodiment, the track unit may include an upper region having a curved shape, and the plurality of first bearings may be arranged to correspond to the curved shape of the upper region of the track unit.

In an embodiment, the belt may include: an upper region; a lower region arranged under the upper region; and a front region and a rear region connecting the upper region to the lower region, and each of the pair of rotation members may include a plurality of third bearings arranged to guide a movement of at least one of the front region and the rear region.

In an embodiment, each of the pair of rotation members may further include a guide roller arranged between the plurality of third bearings and configured to prevent the belt from vibrating in a direction perpendicular to the rotation direction.

In an embodiment, an arrangement of the plurality of third bearings may have a curved shape such that the upper region may smoothly switch to the lower region.

In an embodiment, each of the pair of rotation support units may include a second bearing installed at the frame structure, each of the pair of rotation members may include: a wheel member; and an insertion shaft fixed to the wheel member and inserted into the second bearing, and the insertion shafts of the pair of rotation members may be coaxially arranged spaced apart from each other.

In an embodiment, the track unit may be configured to rotate by a user's foot movement.

Other aspects, features, and advantages other than those described above will become apparent from the accompanying drawings, the appended claims, and the detailed description of the disclosure.

These general and particular embodiments may be implemented by using a system, a method, a computer program, or a combination of the system, the method, and the computer program.

BRIEF DESCRIPTION OF THE DRAWINGS

The above and other aspects, features, and advantages of certain embodiments of the disclosure will be more apparent from the following description taken in conjunction with the accompanying drawings.

DETAILED DESCRIPTION

Figure 1:
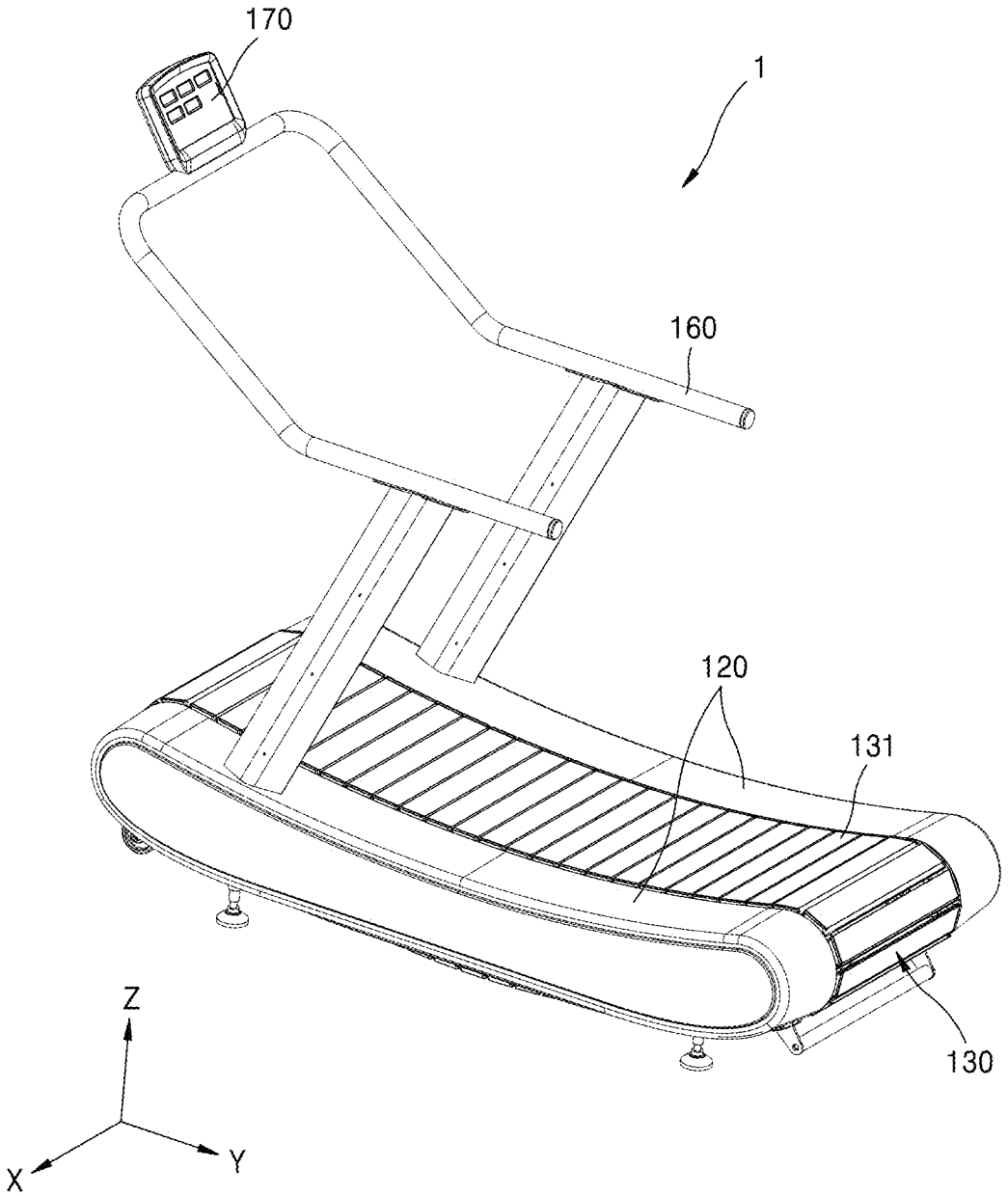
FIG. 1 is a perspective view illustrating a non-powered treadmill according to embodiments.

Reference will now be made in detail to embodiments, examples of which are illustrated in the accompanying drawings, wherein like reference numerals refer to like elements throughout. In this regard, embodiments may have different forms and should not be construed as being limited to the descriptions set forth herein. Accordingly, embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Figure 2:
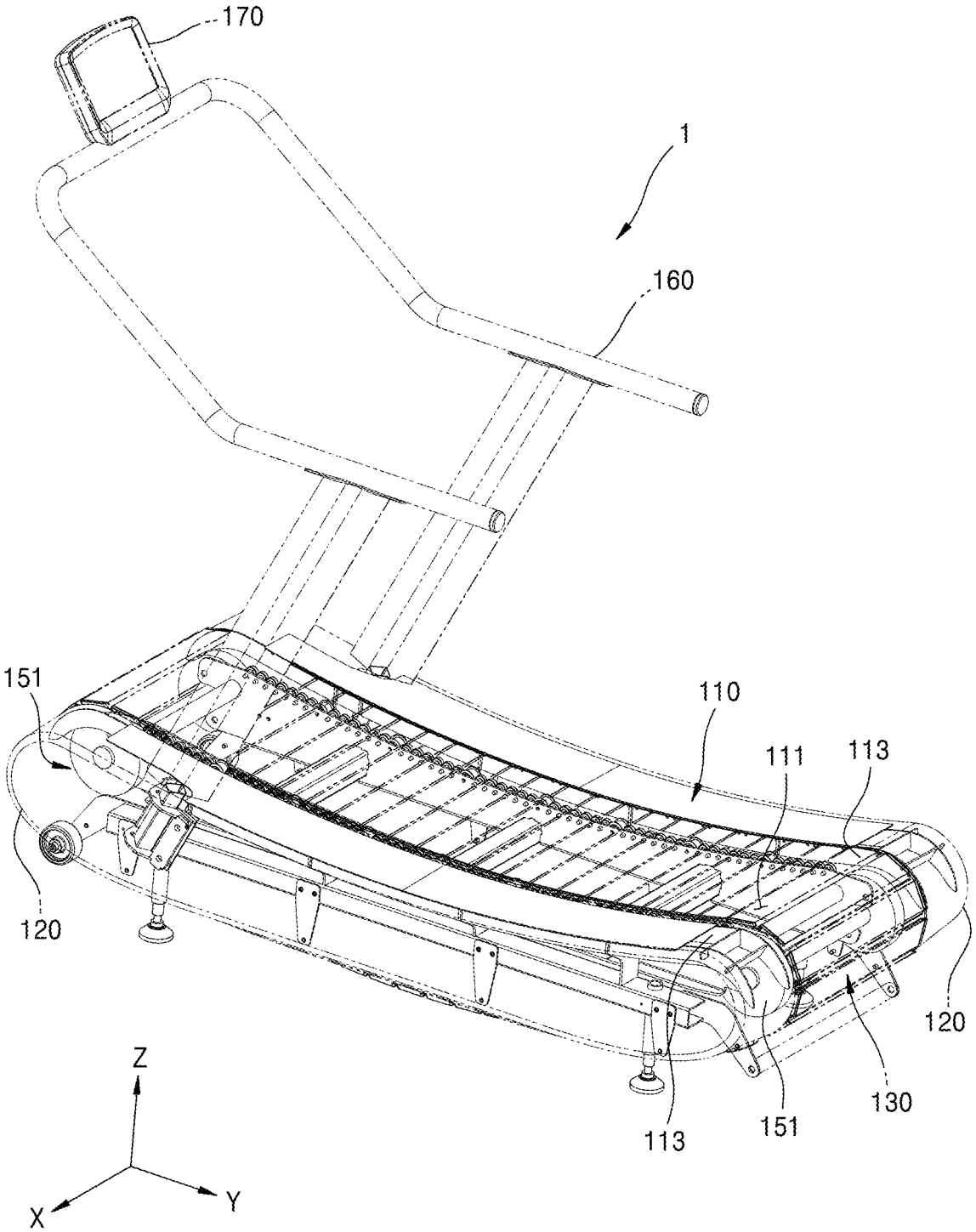
FIG. 2 is a perspective view mainly illustrating an internal structure of the non-powered treadmill of FIG. 1.
Figure 3:
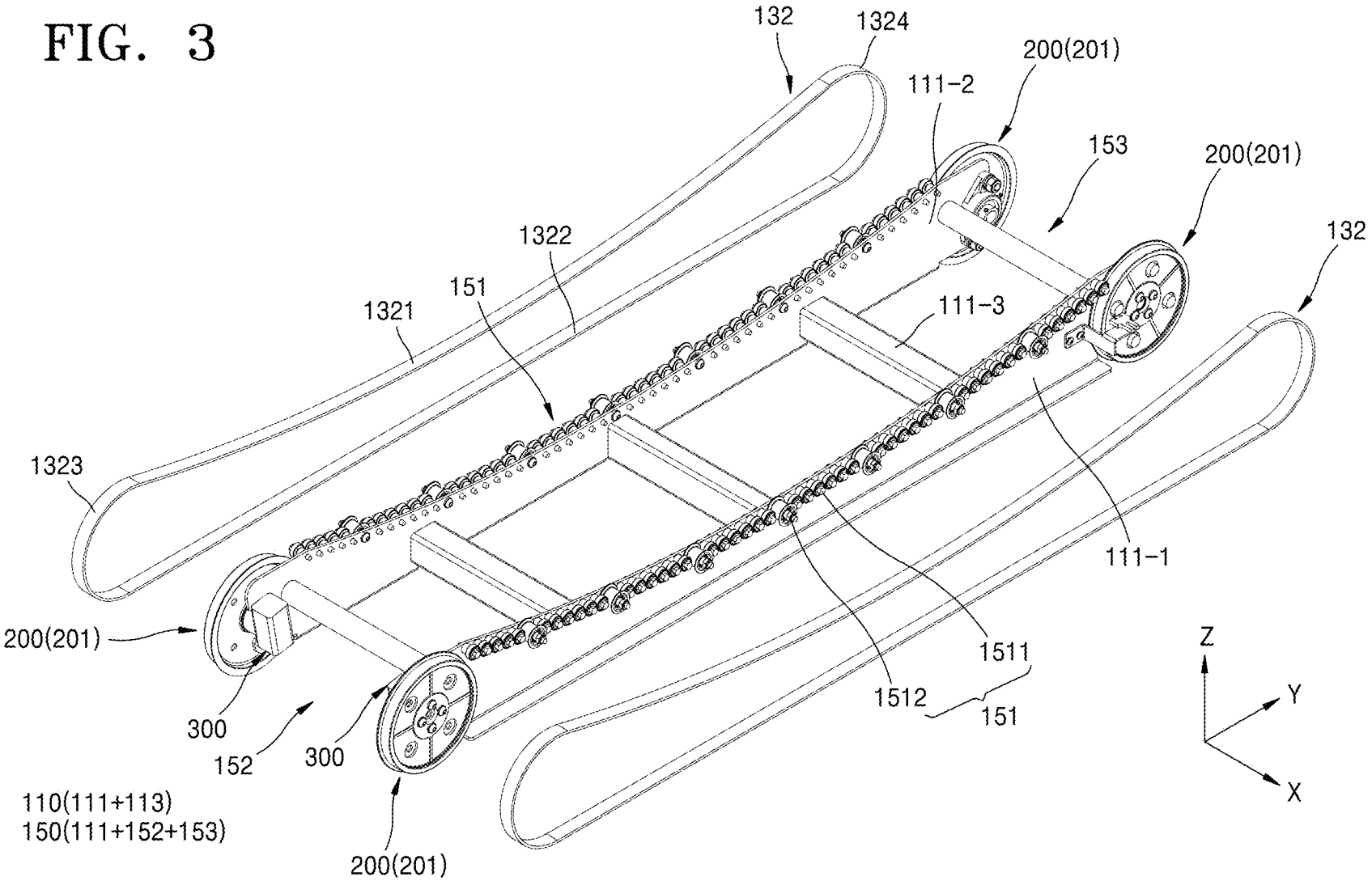
FIG. 3 is a perspective view illustrating an internal structure of a non-powered treadmill.
Figure 4:
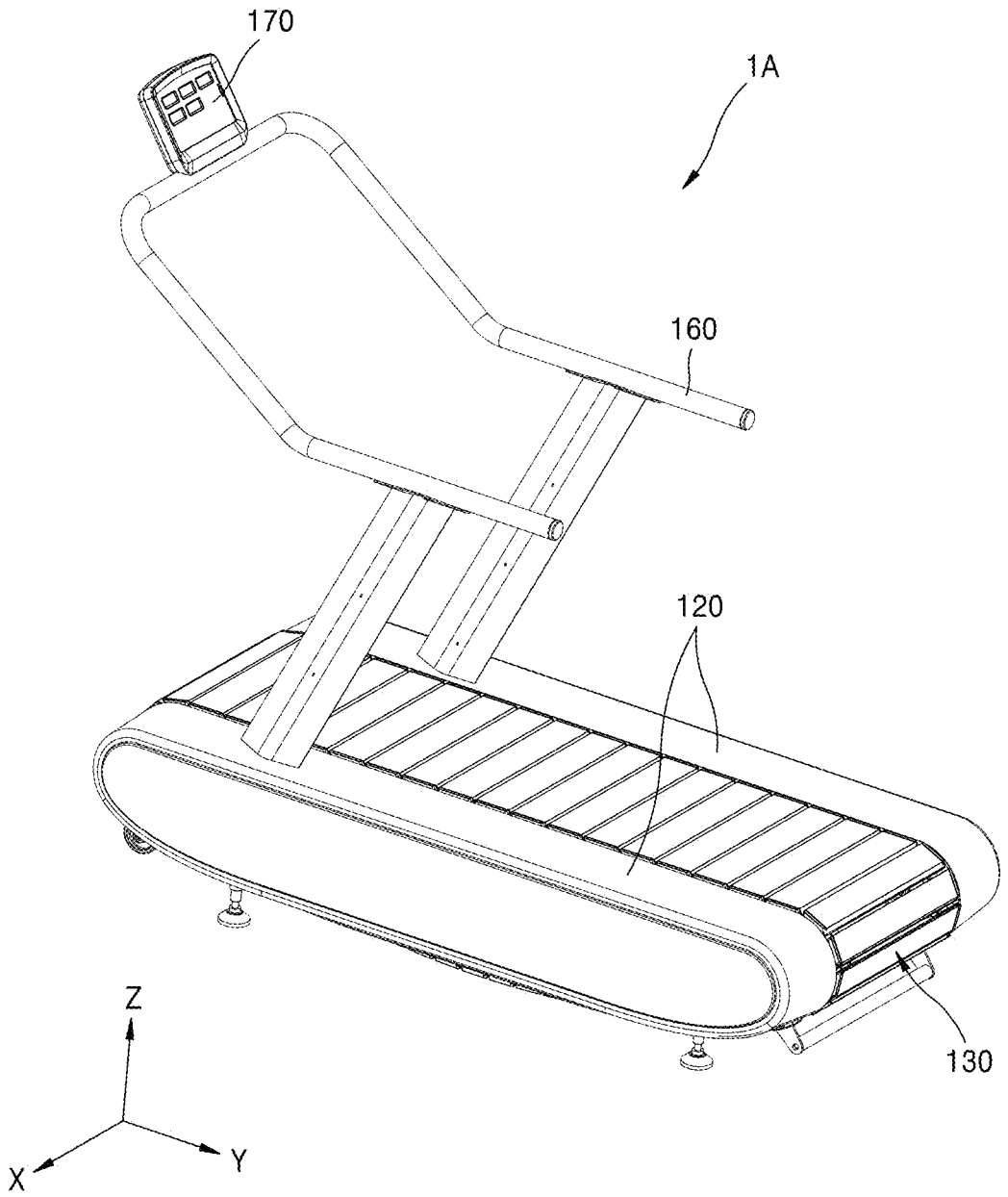
FIG. 4 is a perspective view illustrating a non-powered treadmill according to other embodiments.

FIG. 1 is a perspective view illustrating a non-powered treadmill 1 according to embodiments, and FIG. 2 is a perspective view mainly illustrating an internal structure of the non-powered treadmill 1 of FIG. 1. FIG. 3 is a perspective view illustrating an internal structure of a non-powered treadmill 1. FIG. 4 is a perspective view illustrating a non-powered treadmill 1A according to other embodiments.

Referring to FIGS. 1, 2, and 3, in the non-powered treadmill 1 according to embodiments, a track unit 130 may be driven by the foot movement of a user. The non-powered treadmill 1 may refer to a treadmill in which the track unit 130 is drivable in a non-powered manner and may include a treadmill in which other components other than the track unit 130, for example, an output unit 170 and the like, are driven by power. The non-powered treadmill 1 may be referred to as a manual treadmill.

The non-powered treadmill 1 may include a frame structure 110, a track unit 130 rotatable with respect to the frame structure 110, and a rotation device 150 rotatably supporting the track unit 130. The non-powered treadmill 1 may further include a handle unit 160 that may be gripped by the user and an output unit 170 that may display the exercise results.

The frame structure 110 may maintain the shape of the non-powered treadmill 1 and may include a center frame 111 and a side frame 113 arranged at both side portions of the center frame 111. The side frame 113 may be covered by a side cover 120.

The center frame 111 may include a left frame 111-1, a right frame 111-2, and a gap maintaining unit 111-3.

The track unit 130 may include a plurality of slats 131. The plurality of slats 131 may be arranged adjacent to each other in a first direction (Y direction) that is the rotation direction of the track unit 130. Each of the plurality of slats 131 may extend in a second direction (X direction) perpendicular to the rotation direction of the track unit 130.

The plurality of slats 131 may be connected by a connection member, for example, a pair of belts 132. The pair of belts 132 may be arranged at both end portions of the plurality of slats 131.

The slats 131 connected by the belts 132 may form a closed loop. The belts 132 may be wound around the rotation device 150 to be rotated. As the belts 132 rotate, the slats 131 connected by the belts 132 may be rotated.

The weight of the track unit 130 including the slats 131 and the belts 132 may be about 5 kg to about 100 Kg.

Referring to FIGS. 1 to 3, the rotation device 150 may include a pair of bearing trains 151 rotatably installed at the frame structure 110, a front rotation module 152 arranged at a front side of the pair of bearing trains 151, and a rear rotation module 153 arranged at a rear side of the pair of bearing trains 151.

One bearing train 151 among the pair of bearing trains 151 may be installed at the left frame 111-1 and the other bearing train 151 may be installed at the right frame 111-2.

The bearing train 151 may include a plurality of first bearings 1511 arranged along the rotation direction of the belt 132. The bearing train 151 may further include a guide roller 1512 arranged between the plurality of first bearings 1511.

The track unit 130 may include an upper region having a curved shape. In other words, a running surface thereof may have a curved shape. For this, the plurality of first bearings 1511 of the bearing train 151 may be arranged to correspond to the curved shape of the upper region of the track unit 130.

However, the upper region of the track unit 130 may not necessarily have a curved shape, and as illustrated in FIG. 4, the upper region of the track unit 130 may have a flat shape. In this case, although not illustrated in the drawings, the plurality of first bearings 1511 may be arranged to correspond to the shape of the upper region of the track unit 130.

Referring back to FIGS. 1 to 3, the front rotation module 152 and the rear rotation module 153 may be rotatably installed at the frame structure 110.

At least one of the front rotation module 152 and the rear rotation module 153 may include a pair of rotation members 200 arranged spaced apart from each other in a direction perpendicular to the rotation direction and a pair of rotation support units 300 supporting the pair of rotation members 200.

The pair of rotation members 200 may include a pair of wheel members 201 arranged spaced apart from each other in a direction perpendicular to the rotation direction of the track unit 130 and having a diameter greater than the diameter of the first bearing 1511 of the bearing train 151.

Each of the pair of belts 132 may include an upper region 1321, a lower region 1322 arranged under the upper region 1321, and a front region 1323 and a rear region 1324 connecting the upper region 1321 to the lower region 1322.

The wheel member 201 may guide the movement of at least one of the front region 1323 and the rear region 1324 of the belt 132.

Figure 5:
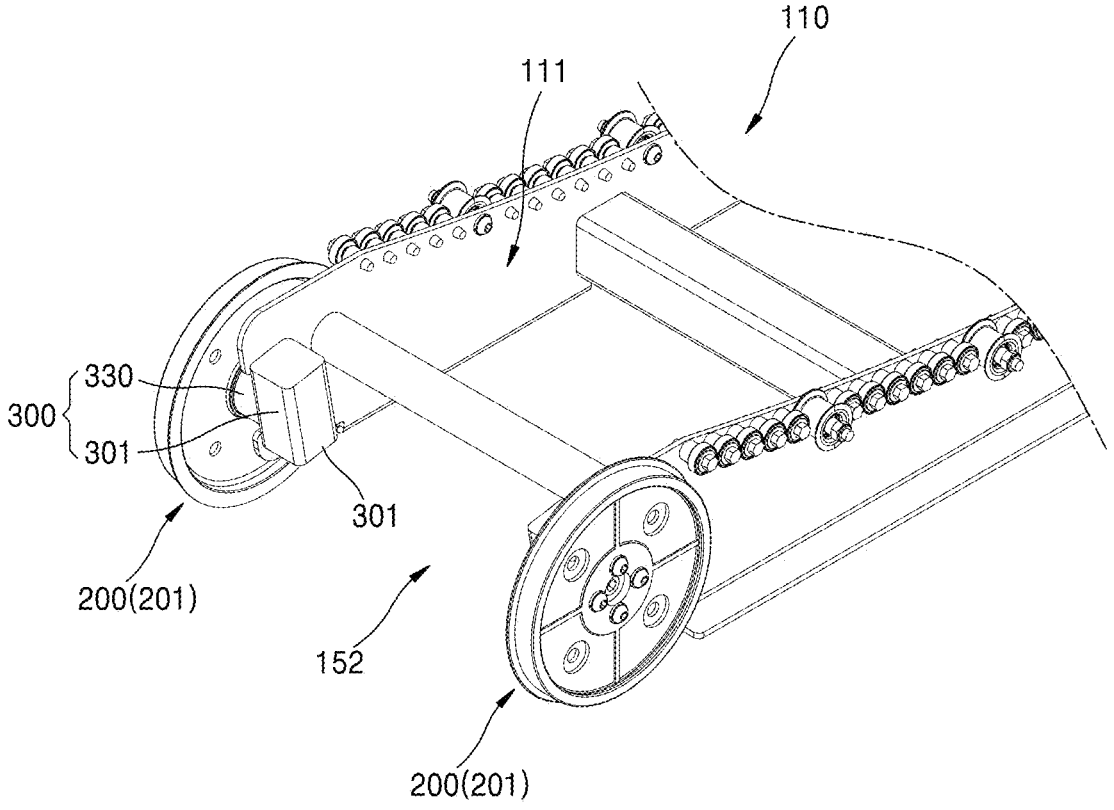
FIGS. 5 and 6 are a perspective view and a cross-sectional view, respectively, for describing a front rotation module of a non-powered treadmill according to embodiments.
Figure 6:
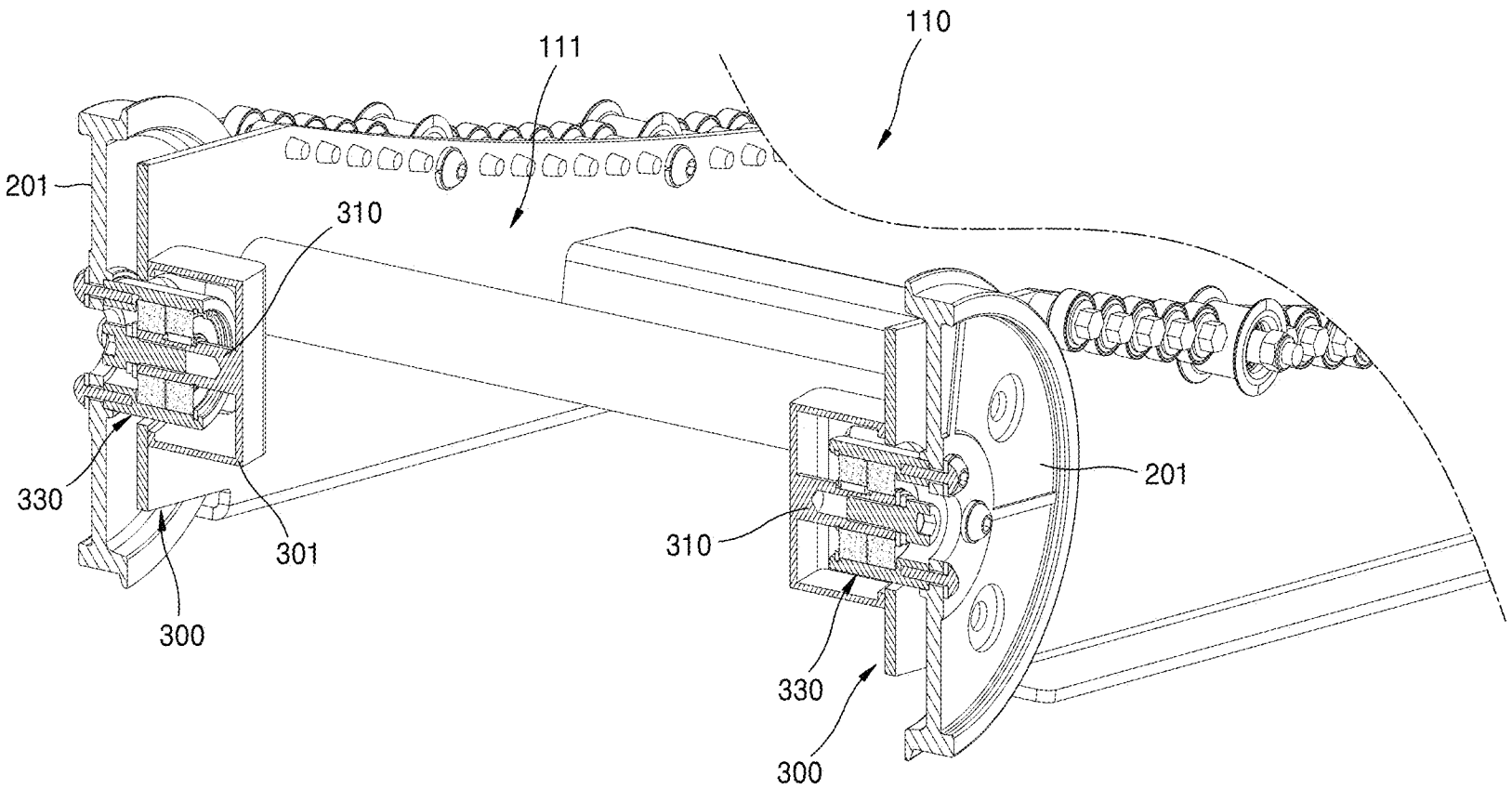
Figure 7:
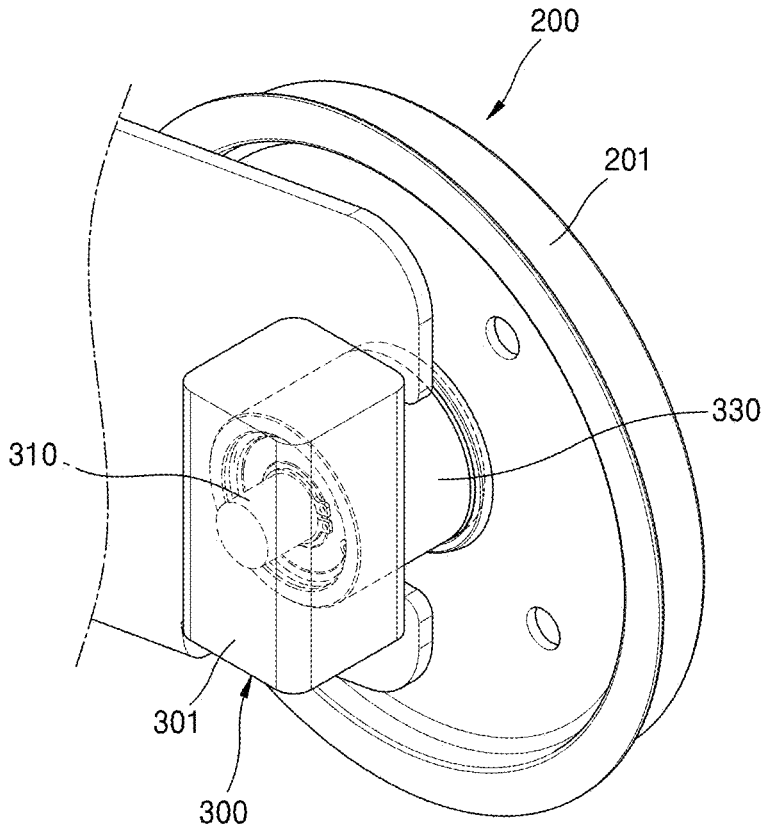
FIG. 7 is an assembled perspective view illustrating a rotation member and a rotation support unit of the front rotation module of FIG. 5.
Figure 8:
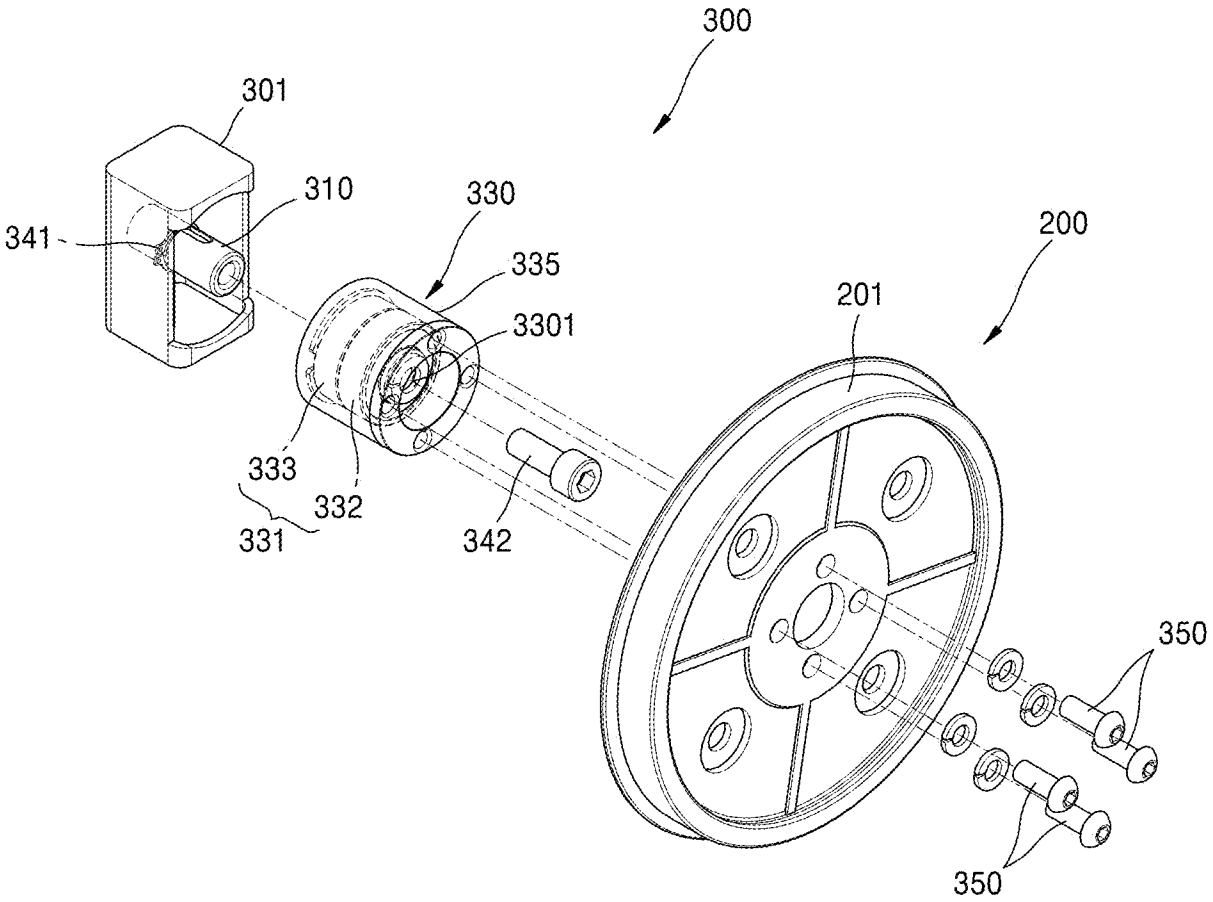
FIGS. 8 and 9 are exploded perspective views illustrating the rotation member and the rotation support unit, respectively, of FIG. 5 at different angles.
Figure 9:
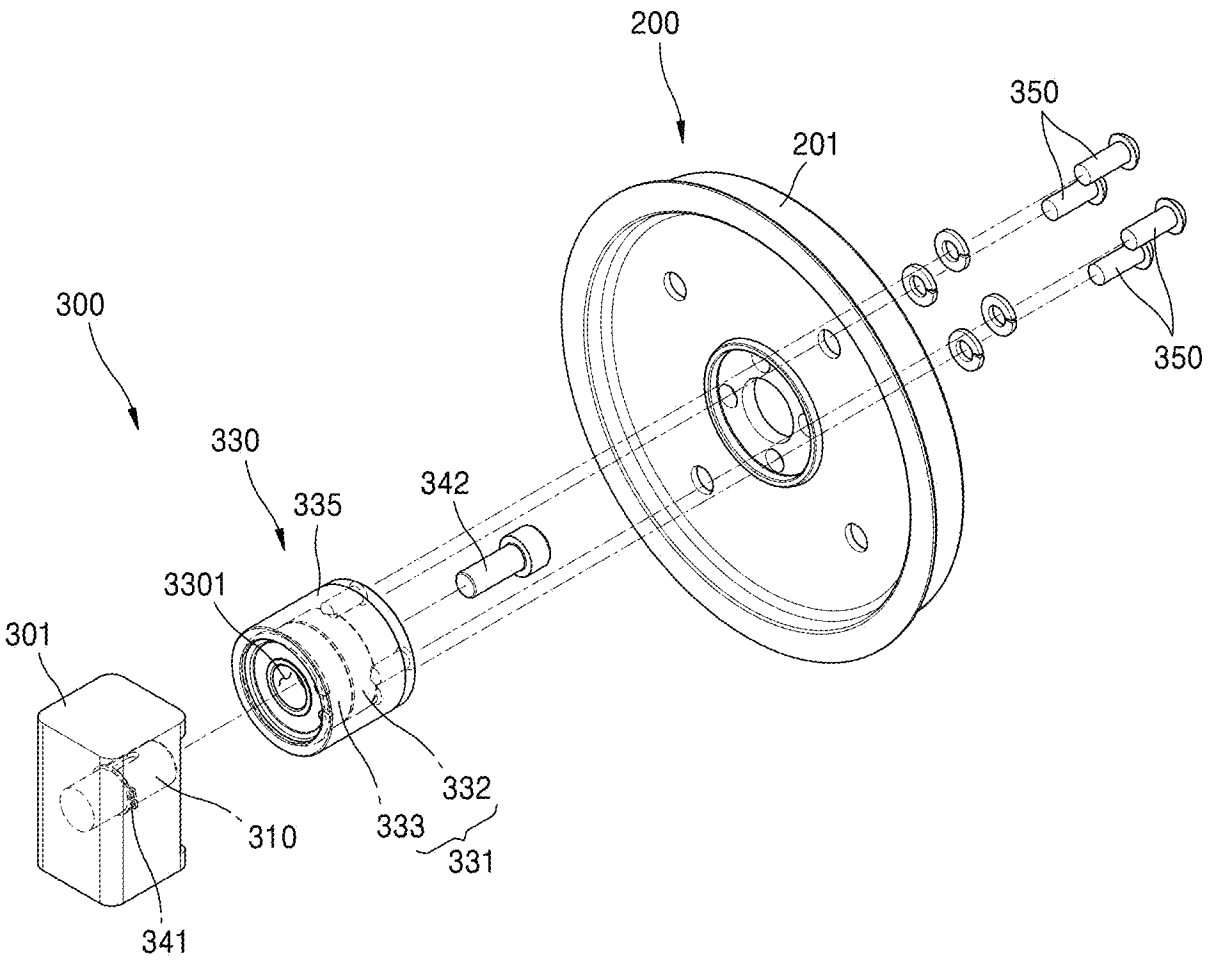

FIGS. 5 and 6 are a perspective view and a cross-sectional view for describing a front rotation module 152 of a non-powered treadmill 1 according to embodiments. FIG. 7 is an assembled perspective view illustrating a rotation member 200 and a rotation support unit 300 of the front rotation module 152 of FIG. 5, and FIGS. 8 and 9 are exploded perspective views illustrating the rotation member 200 and the rotation support unit 300 of FIG. 5 at different angles.

Referring to FIGS. 5 and 6, the pair of rotation support units 300 may support the pair of rotation members 200 such that the pair of rotation members 200 may rotate individually. The pair of rotation members 200 may be rotated independently of each other by the pair of rotation support units 300.

The rotation support unit 300 may include a support shaft 310 fixed to the frame structure 110 and a bearing assembly 330 arranged at the wheel member 201 such that the wheel member 201 may be rotatable with respect to the support shaft 310.

The support shaft 310 may be fixed to the frame structure 110 through a support block 301. The support block 301 may be arranged inside the center frame 111. As the support shaft 310 is fixed by the support block 301 arranged inside the center frame 111, an end portion of the support shaft 310 may be aligned with a side surface of the center frame 111.

However, the support shaft 310 may not necessarily be fixed to the frame structure 110 through the support block 301 and may be directly fixed to the frame structure 110 when necessary.

Referring to FIGS. 7 to 9, the bearing assembly 330 may include an insertion hole 3301 into which the support shaft 310 may be inserted. The bearing assembly 330 may be installed at the support shaft 310 through the insertion hole 3301 along the extension direction of the support shaft 310.

The bearing assembly 330 may include at least one second bearing 331 and a connection boss 335 for connecting the second bearing 331 to the wheel member 201.

The at least one second bearing 331 may include a bearing 332 capable of rotating in both directions and a one-way bearing 333 arranged coaxially with the bearing 332.

The one-way bearing 333 may rotate in one direction but may restrict rotation in the other direction. Accordingly, the one-way bearing 333 may restrict the rotation of the wheel member 201 in one direction. As the rotation of the wheel member 201 in one direction is restricted, the track unit 130 may be prevented from rotating in a direction opposite to the intended direction.

A first stopper 341 may be installed around the support shaft 310. The first stopper 341 may have a C-type ring structure.

The first stopper 341 may guide the assembly position of the bearing assembly 330 when the bearing assembly 330 is installed at the support shaft 310 through the insertion hole 3301. The first stopper 341 may prevent the bearing assembly 330 from being excessively inserted inwardly.

A second stopper 342 may be coupled to an end portion of the support shaft 310. The second stopper 342 may have a bolt structure.

The second stopper 342 may restrict the movement of the bearing assembly 330 such that the bearing assembly 330 installed at the support shaft 310 through the insertion hole 3301 may not deviate from the support shaft 310.

An inner ring of the second bearing 331 may be fixed to the support shaft 310 and an outer ring thereof may rotate with respect to the inner ring.

Figure 10:
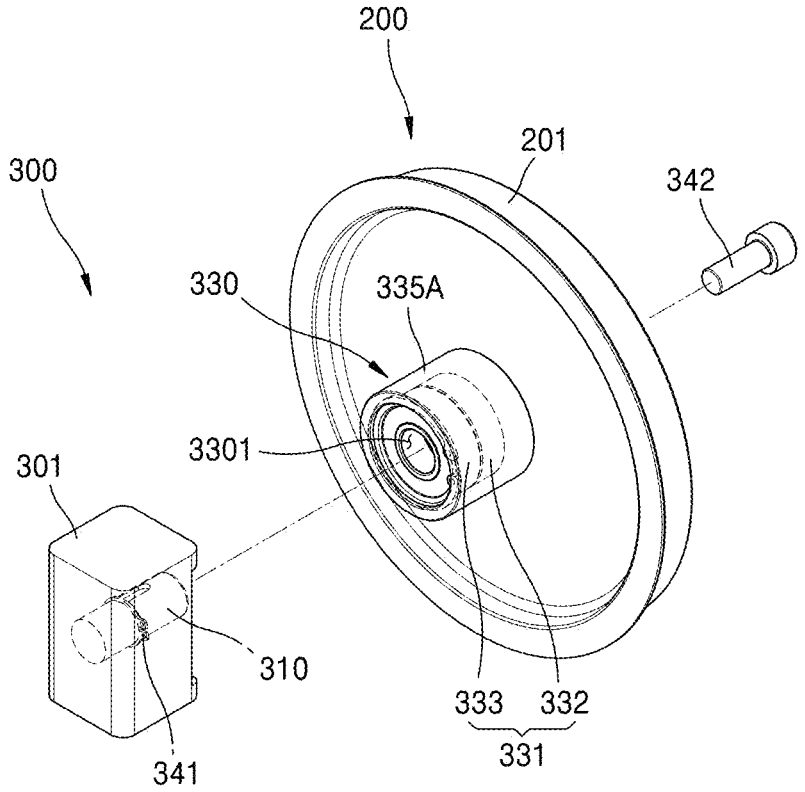
FIG. 10 is an exploded perspective view for describing a rotation support unit according to other embodiments.

The connection boss 335 may be arranged around the second bearing 331 and may be fixed to the outer ring of the second bearing 331. As an example, the connection boss 335 may be arranged to be fixed to the wheel member 201 by a fixing member 350. However, the fixing method of the connection boss 335 is not limited thereto and may be variously modified. For example, as illustrated in FIG. 10, a connection boss 335A may be integrally formed with the wheel member 201 and fixed to the wheel member 201.

The connection boss 335 may include a metal material.

When the wheel member 201 rotates, the connection boss 335 fixed to the wheel member 201 and the outer ring fixed to the connection boss 335 may rotate with respect to the inner ring.

The material of the wheel member 201 may be lighter than the material of the connection boss 335 and the support shaft 310. For example, when the material of the connection boss 335 and the support shaft 310 is a metal material, the material of the wheel member 201 may be a plastic material.

As described above, because the front rotation module 152 has a structure in which the pair of rotation members 200 rotate individually, the weight of the front rotation module 152 may be reduced.

If the front rotation module 152 has a structure in which the pair of rotation members 200 are fixed to one rotation shaft to rotate together with the rotation shaft instead of rotating individually, the front rotation module 152 may be influenced by the weight of the rotation shaft.

On the other hand, the front rotation module 152 according to embodiments may remove the influence of the weight of the rotation shaft because it has a structure in which the pair of rotation members 200 are not fixed to the rotation shaft. Accordingly, the weight of the rotation device 150 rotating the track unit 130 may be reduced and the rotational inertia of the track unit 130 may be minimized.

Meanwhile, in the above embodiments, an example in which the support shafts 310 of the pair of the rotation support units 300 are spaced apart from each other has been mainly described; however, the present disclosure is limited thereto.

Figure 11:
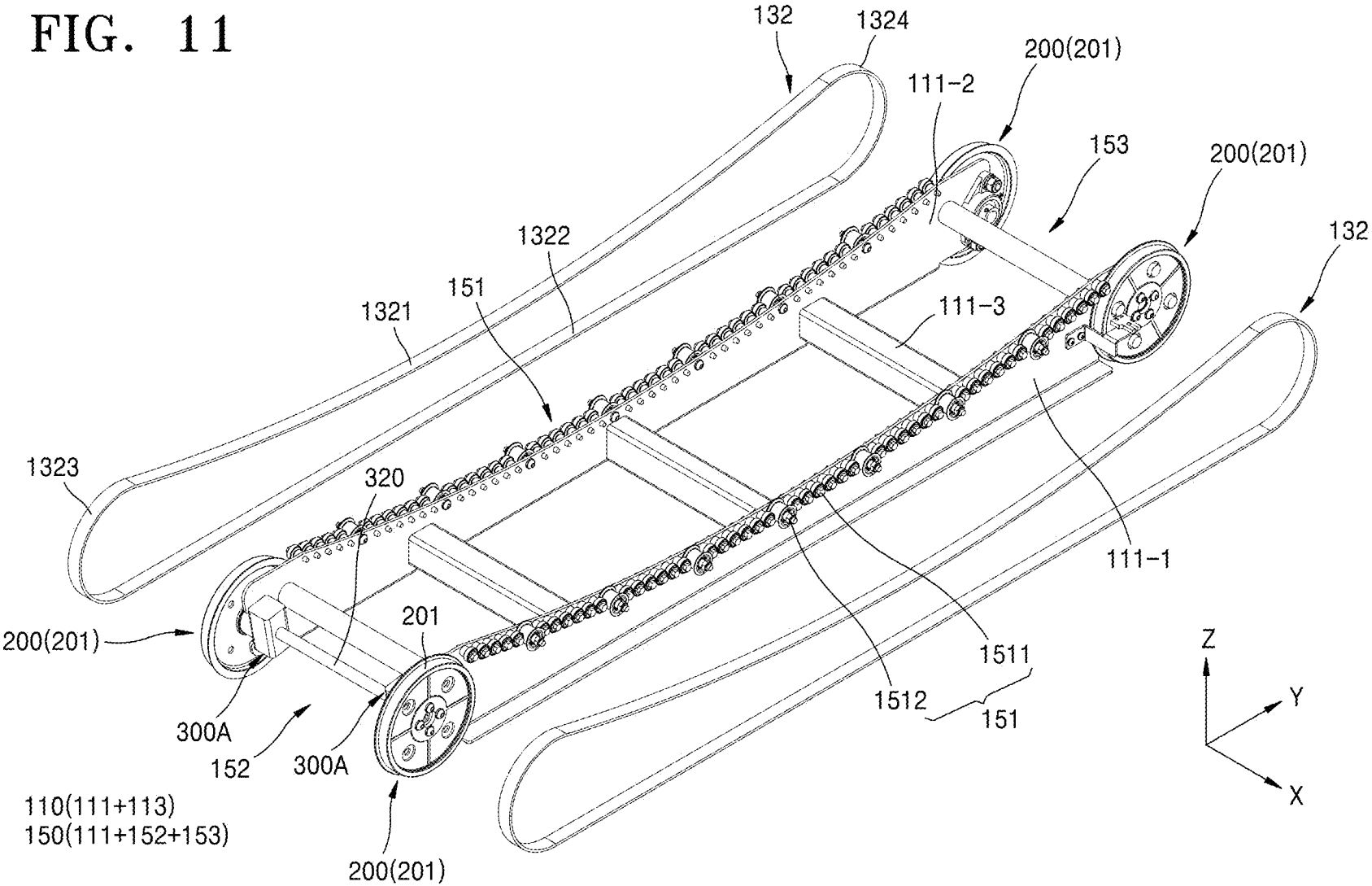
FIG. 11 is a perspective view for describing a rotation member and a rotation support unit of a non-powered treadmill according to other embodiments.

FIG. 11 is a perspective view for describing a rotation member 200 and a rotation support unit 300A of a non-powered treadmill 1 according to other embodiments. For example, as illustrated in FIG. 11, a pair of support shafts 310 of a pair of rotation support units 300A according to embodiments may be connected to each other by a connection shaft 320. The pair of support shafts 310 and the connection shaft 320 may have an integrated structure.

Also, in the above embodiments, an example in which the pair of rotation members 200 rotate individually in the front rotation module 152 has been mainly described; however, the present disclosure is not limited thereto.

Figure 12:
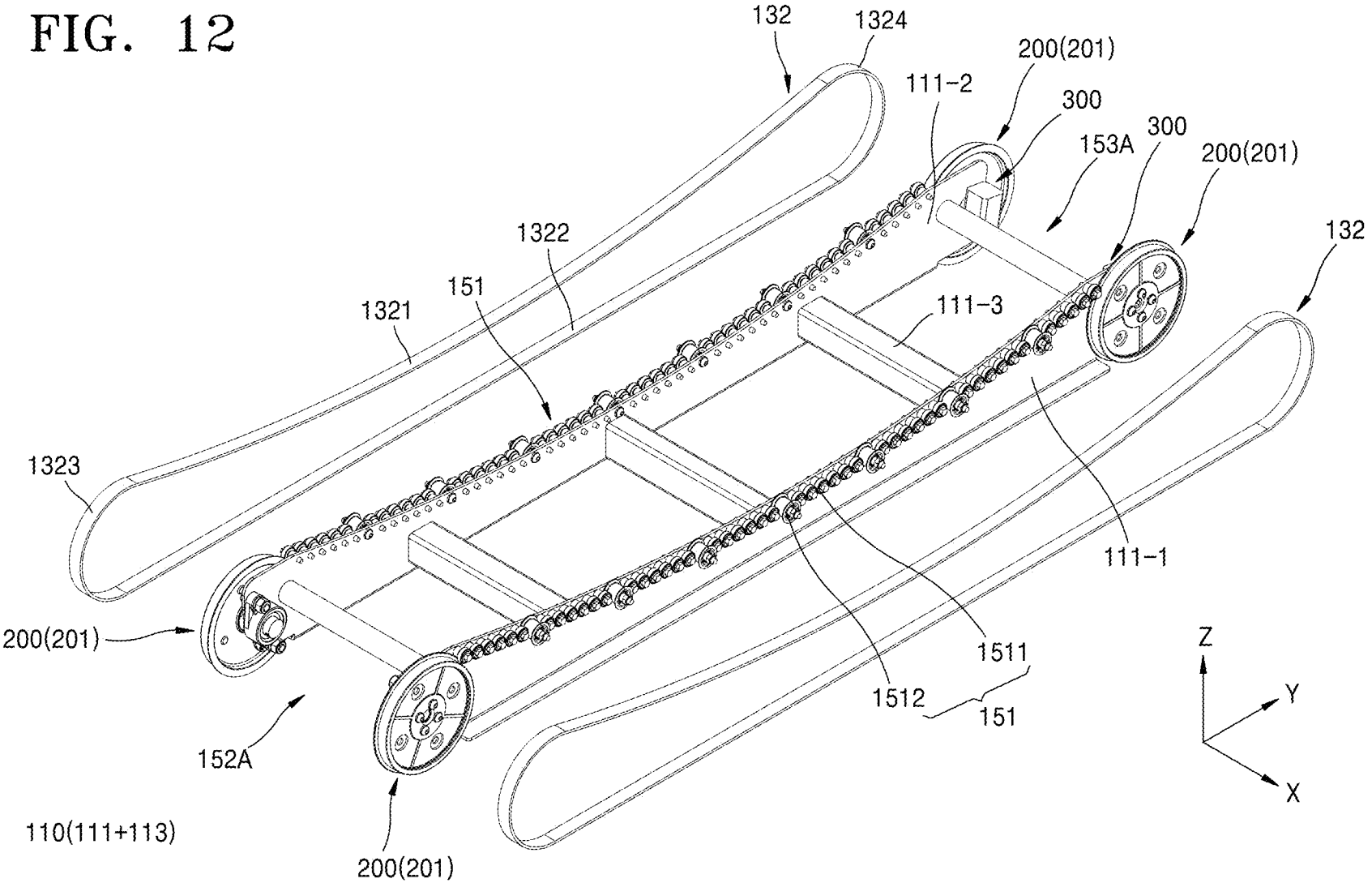
FIGS. 12 and 13 are perspective views for describing a rotation member and a rotation support unit, respectively, of a non-powered treadmill according to other embodiments.
Figure 13:
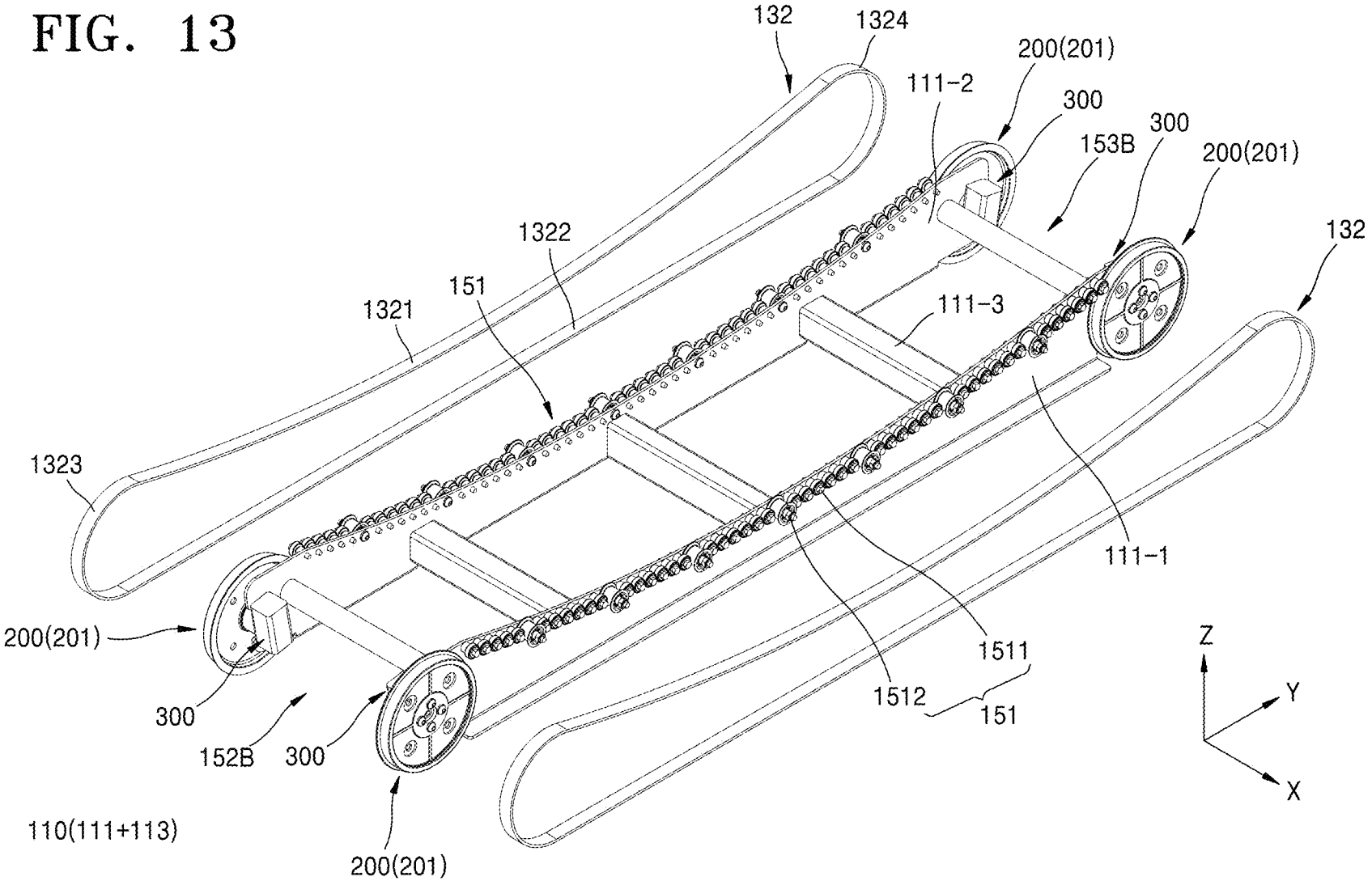

FIGS. 12 and 13 are perspective views for describing a rotation member 200 and a rotation support unit 300 of a non-powered treadmill 1 according to other embodiments.

For example, a pair of rotation members 200 may be configured to rotate individually in a rear rotation module 153A as illustrated in FIG. 12, or a pair of rotation members 200 may be configured to rotate individually in both a front rotation module 152B and a rear rotation module 153B as illustrated in FIG. 13.

Figure 14:
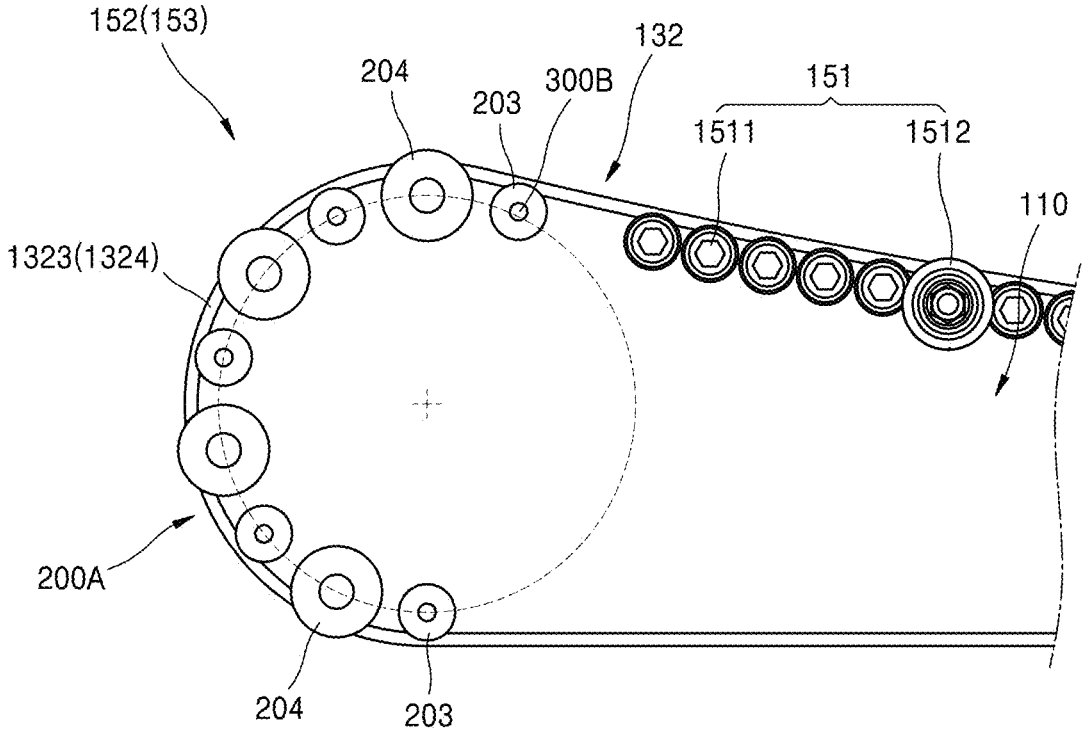
FIG. 14 is a partial side view for describing a rotation member and a rotation support unit of a non-powered treadmill according to other embodiments.
Figure 15:
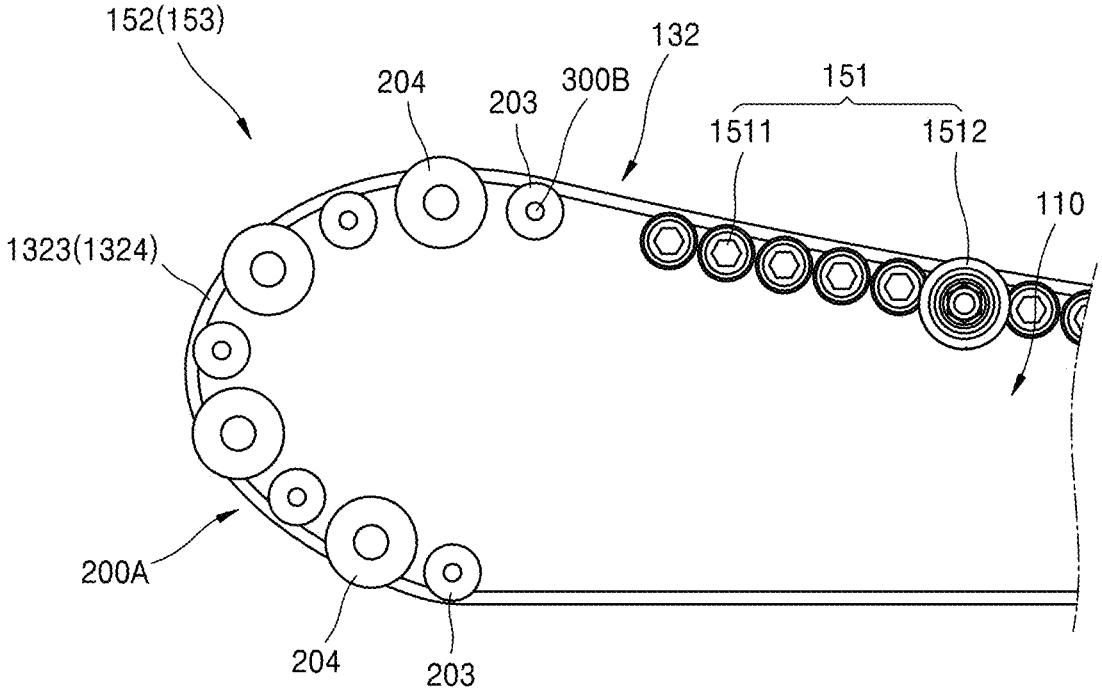
FIG. 15 is a partial side view for describing a rotation member and a rotation support unit of a non-powered treadmill according to other embodiments.

In the above embodiments, it has been mainly described that the pair of rotation members 200 are the wheel members 201; however, the pair of rotation members 200 may be implemented in various forms. FIG. 14 is a partial side view for describing a rotation member 200A and a rotation support unit 300B of a non-powered treadmill 1 according to other embodiments. FIG. 15 is a partial side view for describing a rotation member 200A and a rotation support unit 300B of a non-powered treadmill 1 according to other embodiments.

For example, as illustrated in FIG. 14, in the non-powered treadmill 1 according to embodiments, in at least one of the front rotation module 152 and the rear rotation module 153, each of the pair of rotation members 200 may include a plurality of third bearings 203. A guide roller 1512 configured to prevent the belt 132 from vibrating in a direction perpendicular to the rotation direction may be arranged between the plurality of third bearings 203.

The third bearing 203 may be rotatably supported by the rotation support unit 300B installed at the frame structure 110.

The plurality of third bearings 203 may be arranged to guide the movement of at least one of the front region 1323 and the rear region 1324 of the belt 132.

The arrangement of the plurality of third bearings 203 may have a curved shape such that the upper region 1321 may smoothly switch to the lower region 1322. As an example, the arrangement of the plurality of third bearings 203 may be a portion of a circular shape as illustrated in FIG. 14, and as another example, the arrangement of the plurality of third bearings 203 may be a portion of an ellipse as illustrated in FIG. 15. As described above, when the rotation member 200 includes the plurality of third bearings 203, the rotation member 200 may be arranged in various shapes other than a circular shape. Accordingly, an arrangement suitable for natural rotation of the belt 132 may be freely implemented and also the size and height of the non-powered treadmill 1 may be reduced by reducing the size occupied by the rotation member 200.

Also, in the above embodiments, a structure in which the outer ring of the second bearing 331 rotates in a state where the inner ring of the second bearing 331 is fixed to the support shaft 310 in each of the pair of rotation support units 300 and 300A has been mainly described. However, the pair of rotation support units 300 may be variously modified as long as there are within the range of supporting the pair of rotation members 200 to rotate individually.

Figure 16:
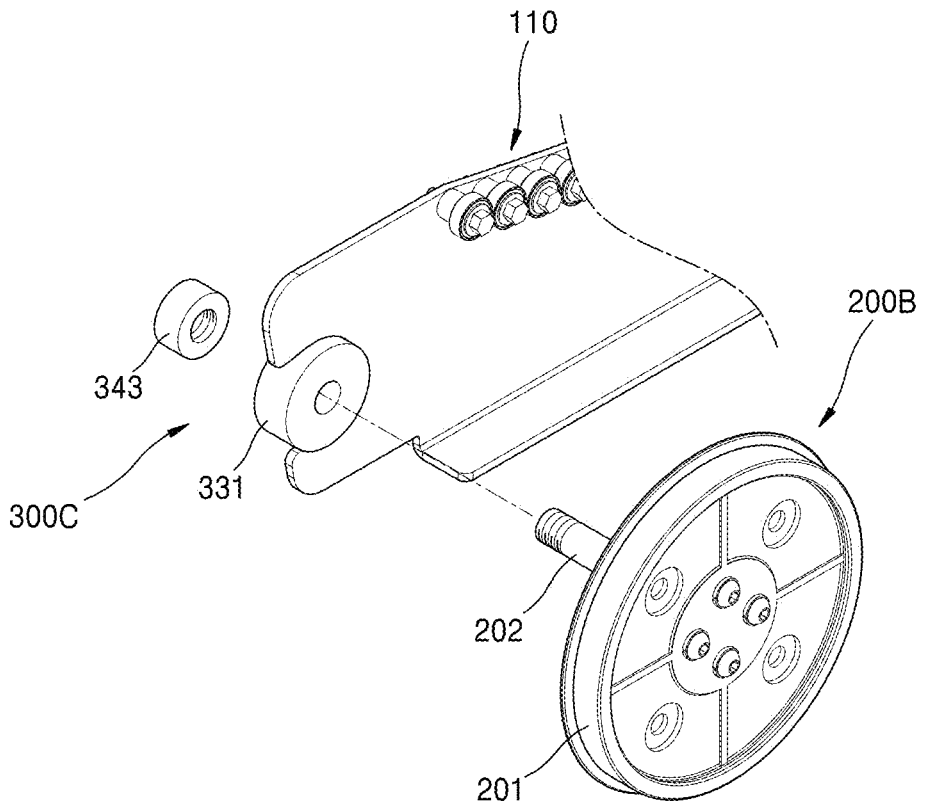
FIG. 16 is an exploded perspective view for describing a rotation member and a rotation support unit of a non-powered treadmill according to other embodiments.

FIG. 16 is an exploded perspective view for describing a rotation member 200B and a rotation support unit 300C of a non-powered treadmill 1 according to other embodiments.

For example, as illustrated in FIG. 16, a second bearing 331 of the rotation support unit 300C may be installed at the frame structure 110, and the rotation member 200B may include a wheel member 201 and an insertion shaft 202 fixed to the wheel member 201 and inserted into the second bearing 331.

The insertion shaft 202 may pass through the second bearing 331 and a third stopper 343 may be arranged at an end portion thereof. The position movement of the rotation member 200B may be restricted by the third stopper 343.

In a state where the insertion shaft 202 of the rotation member 200B is inserted into the second bearing 331, as the rotation member 200B rotates, the inner ring of the second bearing 331 may rotate with respect to the outer ring thereof.

In FIG. 16, one insertion shaft 202 among a pair of insertion shafts 202 is illustrated and the other insertion shaft 202 is not illustrated; however, the other insertion shaft 202 may also have the same structure.

The pair of insertion shafts 202 may be coaxially arranged spaced apart from each other.

Meanwhile, in the above embodiments, the non-powered treadmill in which the track unit is driven by the user's foot movement has been mainly described; however, the present disclosure is not limited thereto and may also be applied to a powered treadmill in which a track unit is driven by power or to a hybrid treadmill in which a track unit may be driven in both powered and non-powered manners.

According to the non-powered treadmills of embodiments of the present disclosure, the rotational inertia of the track unit may be minimized by reducing the weight of the rotation device rotating the track unit.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A treadmill comprising:

a frame structure;

a track unit rotatable with respect to the frame structure; and a rotation device arranged at the frame structure to rotatably support the track unit, wherein the track unit includes:

a plurality of slats arranged along a rotation direction of the track unit; and a pair of belts arranged at both end portions of the plurality of slats to connect the plurality of slats to each other, wherein the rotation device includes:

a pair of bearing trains rotatably installed at the frame structure and including a plurality of first bearings arranged along a movement direction of the pair of belts to guide a movement of an upper region of the pair of belts; and a front rotation module and a rear rotation module rotatably installed at the frame structure and respectively arranged at a front side and a rear side of the pair of bearing trains, wherein at least one of the front rotation module and the rear rotation module includes:

first and second rotation members arranged spaced apart from each other in a direction perpendicular to a rotation direction thereof, the first and second rotation members respectively comprising first and second inner sides facing each other; and first and second rotation support units configured to respectively support the first and second rotation members such that the first and second rotation members rotate individually, and wherein the first rotation support unit includes:

a first support shaft;

a first support block configured to fix the first support shaft to the frame structure, the first support block disposed to face the first inner side of the first rotation member; and a first bearing assembly arranged at the first rotation member such that the first rotation member is rotatable with respect to the first support shaft, wherein the second rotation support unit includes:

a second support shaft separate from and independent of, and unconnected to the first support shaft;

a second support block configured to fix the second support shaft to the frame structure, the second support block unconnected to the first support block, the second support block disposed to face the second inner side of the second rotation member such that a distance between the first and second support blocks is less than a distance between the first and second rotation members; and a second bearing assembly arranged at the second rotation member such that the second rotation member is rotatable with respect to the second support shaft.

2. The treadmill of claim 1, wherein the first rotation member includes a wheel member having a diameter greater than a diameter of a first bearing of the plurality of first bearings, the second rotation member includes a wheel member having a diameter greater than a diameter of a second bearing.

3. The treadmill of claim 2, wherein the frame structure includes:

a center frame including a left frame, a right frame, and a gap maintaining unit maintaining a gap between the left frame and the right frame; and a side frame arranged at both side portions of the center frame, and wherein each of the first and second support blocks is arranged inside the center frame.

4. The treadmill of claim 3, further comprising:

a connection boss configured to connect the second bearing assembly to the wheel member of the second rotation member.

5. The treadmill of claim 4, wherein the second bearing assembly includes:

a bearing configured to rotate in both directions; and a one-way bearing arranged coaxially with the bearing and restricted to rotate in one direction.

6. The treadmill of claim 4, wherein the connection boss is arranged to be fixed to the wheel member of each of the first and second rotation members.

7. The treadmill of claim 4, wherein a material of the wheel member of each of the first and second rotation members is lighter than a material of the connection boss, the first and second support shafts.

8. The treadmill of claim 3, wherein each of the first and second bearing assemblies includes an insertion hole into which the respective support shaft is inserted, and wherein each of the first and second rotation support units further includes a first stopper arranged around the respective support shaft to guide an assembly position of each of the first and second bearing assemblies when each of the first and second bearing assemblies is installed at the respective support shaft through the insertion hole.

9. The treadmill of claim 8, wherein each of the first and second rotation support units further includes a second stopper coupled to an end portion of the respective support shaft such that each of the first and second bearing assemblies does not deviate from the respective support shaft.

10. The treadmill of claim 1, wherein the frame structure includes a left frame and a right frame, wherein the first support block is coupled to a first end of the left frame, wherein the second support block is coupled to a second end of the right frame, wherein the first end of the left frame is disposed between the first support block and the first inner side of the first rotation member, and wherein the second end of the right frame is disposed between the second support block and the second inner side of the second rotation member.

11. The treadmill of claim 10, wherein the first end of the left frame has a first groove configured to pass the first bearing assembly therethrough, and wherein the second end of the right frame has a second groove configured to pass the second bearing assembly therethrough.

12. The treadmill of claim 1, wherein the first support shaft comprises a first end coupled to the first rotation member and a second opposing end fully enclosed by the first support block, and wherein the second support shaft comprises a first end coupled to the second rotation member and a second opposing end fully enclosed by the second support block.

13. The treadmill of claim 12, wherein the first and second support shafts extend in a first direction, and wherein each of the first and second support blocks has an elongated shape extending in a second direction crossing the first direction.

14. The treadmill of claim 1, wherein the track unit includes an upper region having a curved shape, and wherein the plurality of first bearings are arranged to correspond to the curved shape of the upper region of the track unit.

15. The treadmill of claim 1, wherein no intervening shaft is provided between and coupled to the first and second support blocks.

* * * * *